United States Patent [19]

Madsen

[11] 3,964,126

[45] June 22, 1976

[54] HANDLE ATTACHMENT FOR DRINKING WATER BOTTLE

[76] Inventor: Fred C. Madsen, 844 San Pablo St., Long Beach, Calif. 90813

[22] Filed: June 30, 1975

[21] Appl. No.: 591,780

[52] U.S. Cl. ..... 16/114 R; 294/31.2

[51] Int. Cl.[2] ..... B65D 63/18

[58] Field of Search ..... 16/114 R; 215/100 A; 294/31.2; 224/45 R, 45 A, 45 P, 55, 54

[56] References Cited

UNITED STATES PATENTS

| | | | |
|---|---|---|---|
| 1,460,268 | 6/1923 | Ottman | 294/31.2 X |
| 1,838,348 | 12/1931 | Woodman | 294/31.2 |
| 2,385,913 | 10/1945 | Fink | 224/45 R |
| 3,050,326 | 8/1962 | Miller | 294/31.2 |
| 3,615,115 | 10/1971 | Simms | 16/114 R |

*Primary Examiner*—Andrew V. Kundrat

*Attorney, Agent, or Firm*—William C. Babcock

[57] ABSTRACT

A handle attachment capable of frictionally engaging a cylindrical side wall of a carboy type bottle, such as a five-gallon bottle in which drinking water is delivered, to permit the bottle to be conveniently lifted and placed in an inverted position on a dispenser.

4 Claims, 8 Drawing Figures

FIG. 1
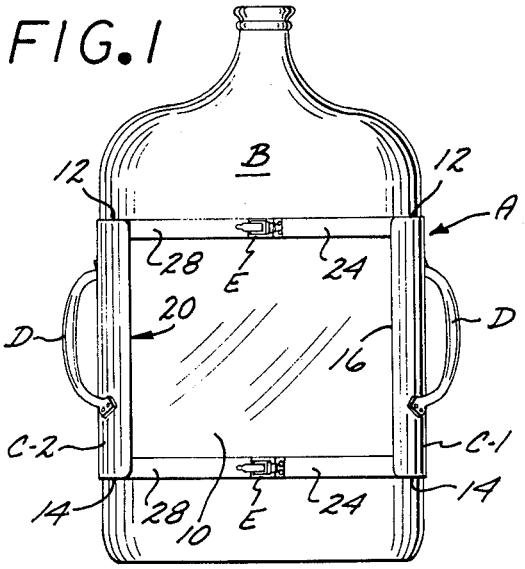
FIG. 2
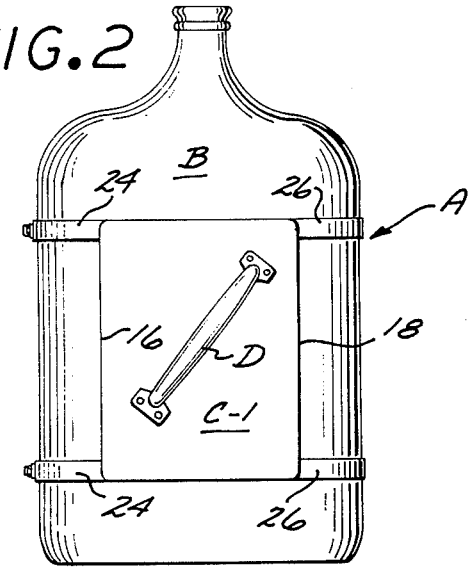
FIG. 3
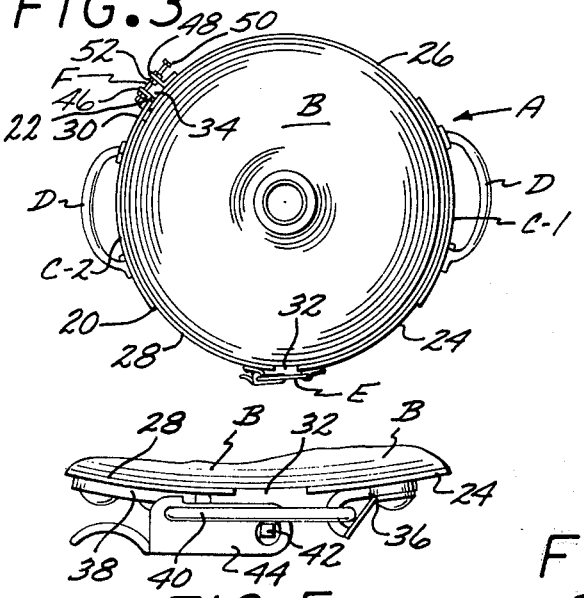
FIG. 4
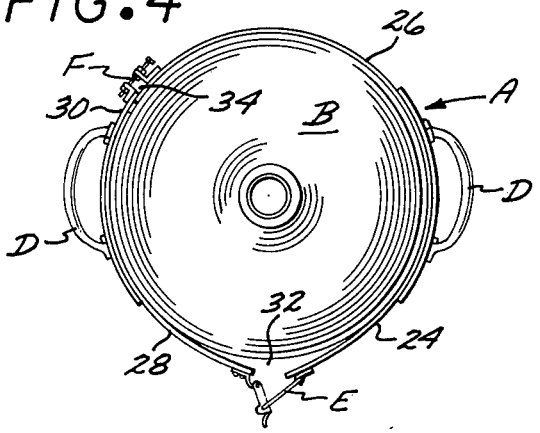
FIG. 5
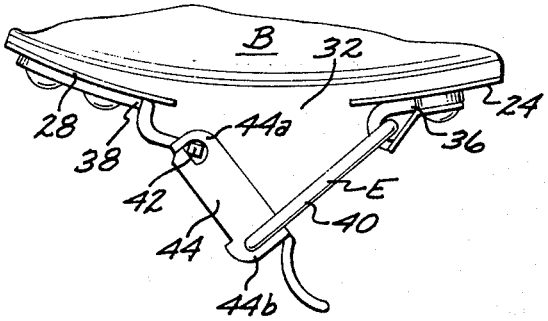
FIG. 6
FIG. 8
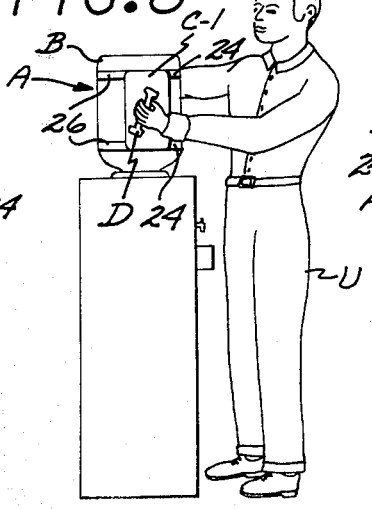
FIG. 7
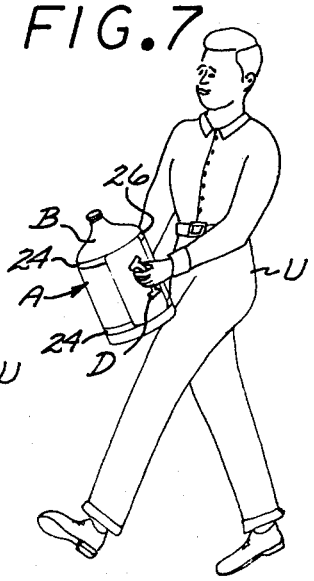

HANDLE ATTACHMENT FOR DRINKING WATER BOTTLE

BACKGROUND OF THE INVENTION

1. Field of the Invention

Handle attachment for drinking water bottle.

2. Description of the Prior Art

Drinking water is commonly delivered to residences and offices in five gallon carboy type bottles. A bottle after being opened must be lifted to a substantial elevation, and then placed in an inverted position on a dispenser.

The combined weight of the bottle and the water contained therein is so great that it is impossible for the average woman to lift the same and dispose the bottle in an inverted position on a dispenser. Although a man can lift such a bottle, it requires the expenditure of substantial physical energy, and is not uncommon for even a man to drop a bottle during the lifting thereof and sustain substantial injuries due to the dropped bottle shattering into a number of sharp pieces that may contact him.

A major object of the present invention is to supply a handle attachment that may be removably secured to a carboy type bottle, with the attachment including two oppositely positioned handles, which handles may be grasped by two women to permit the bottles to be raised and disposed in an inverted position. The handles are so disposed when the attachment is mounted on a bottle that the handles may be concurrently grasped by a man to conveniently elevate the bottle to a desired degree where the bottle may be placed in an inverted position.

Another object of the invention is to supply a handle attachment that is removably securable to the cylindrical side wall of a carboy type bottle, and when so mounted is sufficiently attractive to permit it to remain in place on the bottle after the latter has been disposed in an inverted position on a dispenser or water cooler.

Another object of the invention is to supply a handle attachment for a carboy type bottle that has a simple mechanical structure, can be fabricated from standard commercially available materials, is simple and easy to mount on a bottle, may be removed from the bottle by a simple manual operation, and due to its simplicity of structure can be retailed at a sufficiently low cost as to encourage the widespread use thereof.

A still further object of the invention is to supply a handle attachment for a carboy type bottle that minimizes the possibility of the bottle being dropped during the elevating and inverting of the latter to occupy a desired elevated position, and as a result the possibility of a person elevating the bottle being injured due to the bottle dropping and shattering being substantially eliminated.

SUMMARY OF THE INVENTION

A handle assembly that is removably attachable to a carboy type bottle of the type in which drinking water is contained, which bottle has a straight cylindrical side wall. The handle assembly after being removably secured to the side wall of the bottle, permits the bottle to be lifted by handles that form a part of the assembly to a desired elevation where the bottle may be inverted into a supported position on a water dispenser or water cooler. The handle assembly or attachment includes first and second transversely positioned arcuate rigid sheets that may be disposed on opposite sides of the carboy type bottle, when the bottle is in an upright position. The first and second sheets each have upper and lower circumferential edges, and the first sheet when the carboy is in the upright position has first and second vertical edges that extend between the upper and lower circumferential edges thereof. The second sheet has third and fourth vertical edges that extend between the upper and lower edges thereof. First and second outwardly projecting handles are secured to the first and second sheet. First, second, third and fourth pairs of pliable horizontal bands are provided. The first and second pairs of bands are connected to the first sheet and extend in opposite directions from the first and second edges thereof. The third and fourth pairs of bands are connected to the second sheet and extend in opposite directions from the third and fourth edges thereof. The first and third pairs of bands have free ends that are separated by a first space, and the second and fourth bands have free ends that are separated by a second space.

A pair of manually operable locking means are connected to the free ends of the first and third bands and disposed in the first spaces. The first manually operable locking means is capable of occupying first and second positions, with the first manually operable locking means when in the first position holding the free ends of the first and third bands a minimum distance from one another. The first manually operable locking means when in second positions holds the free ends of the first and third bands a maximum distance from one another.

A pair of manually adjustable means are provided that are connected to the free ends of the second and fourth pairs of bands and disposed in the second spaces for so adjusting the length of the second spaces that when the first manually operable locking means are moved from the second to the first position, the first and second sheets and the first, second, third and fourth bands are forced into pressure frictional contact with the cylindrical side wall of the bottle to the extent that the bottle may be lifted by the first and second handles and disposed in an inverted position, and the first manually operable locking means when in the second position increasing the length of the second spaces to the extent that the handle assembly may be moved longitudinally relative to the cylindrical side wall of the bottle to be mounted on or removed from the latter.

BRIEF DESCRIPTION OF THE DRAWING

FIG. 1 is a first side elevational view of a carboy type water bottle having the handle assembly removably secured thereto;

FIG. 2 is another side elevational view of the carboy type bottle with the handle assembly removably mounted thereon;

FIG. 3 is a top plan view of the bottle with the handle assembly removably secured thereto;

FIG. 4 is a second top plan view of the bottle with the handle assembly still mounted thereon, but in a position to be moved longitudinally relative to the bottle;

FIG. 5 is a fragmentary top plan view of one of the toggle type locks that form a part of the handle assembly in a first position;

FIG. 6 is a top plan view of the toggle type lock shown in FIG. 5 in which it is in a second position that permits the handle assembly to be moved longitudinally relative to the bottle;

FIG. 7 is a perspective view of a user carrying a water bottle by use of the handle assembly; and FIG. 8 is a perspective view of a user inverting the bottle by use of the handle assembly into a supported position on a water cooler.

DESCRIPTION OF THE PREFERRED EMBODIMENT

The handle attachment or assembly A as may be seen in FIGS. 1 and 2 is removably mounted on a carboy type water bottle B having a straight cylindrical side wall 10. Assembly A includes first and second arcuate sheets C-1 and C-2, with each of the sheets having a handle D projecting outwardly therefrom. Each of the sheets C-1 and C-2 has an upper circumferential edge 12, and a lower circumferential edge 14. The first arcuate sheet C-1 has first and second vertical edges 16 and 18 that extend between the upper and lower circumferential edges 12 and 14. The second arcuate sheet C-2 has third and fourth vertical edges 20 and 22 that extend between the upper and lower circumferential edges 12 and 14 thereof.

First and second pairs of vertically spaced bands 24 and 26 are secured to the first arcuate sheet C-1 and extend in opposite directions from the first and second vertical edges 16 and 18 thereof. Third and fourth pairs of vertically spaced bands 28 and 30 are secured to the second arcuate sheet C-2 and extend in opposite directions from the third and fourth vertical edges 20 and 22 thereof. The first and third pairs of bands 24 and 28 are of such length that first spaces 32 are defined between the free ends thereof. The second and fourth pairs of bands 26 and 30 are likewise of such length that second spaces 34 are defined between the free ends thereof.

Each of the manually operable locking means E as can be seen in FIGS. 5 and 6 includes a first bracket 36 secured to the free end of one of the first bands 24 and a second bracket 38 secured to the free end of one of the third bands 28. The first bracket 36 supports a link 40. The second bracket 38 includes a pivot member 42 that has a first end 44a of a handle 44 pivotally mounted thereon, with a second end 44b of the handle being pivotally connected to the end of link 40 opposite that pivotally supported by the first bracket 36. The handle 44 serves as a toggle when it is pivoted in a clockwise direction as shown in FIG. 6 to the position illustrated in FIG. 5 where it will be seen that the link 40 is disposed inwardly from the pivot member 42. When the pair of manually operable locking means E are in the position shown in FIG. 5 they force the first and second arcuate sheets C-1 and C-2 together with the first, second, third and fourth pairs of bands 24, 26, 28 and 30 into frictional pressure engagement with the cylindrical side wall 10 to permit the bottle B to be lifted by a user U as shown in FIG. 7 and 8. The user U when lifting the bottle will be grasping the handles D.

Each of the manually adjustable means F as may been seen in FIGS. 3 and 4 include first and second L-shaped tabs 46 and 48 that are secured to the free ends of second and fourth bands 26 and 30. Each of the first brackets 46 has a tapped bore (not shown) formed therein that is engaged by a screw 50 that extends through an aperture in the bracket 48. Each screw 50 has a pair of collars 52 mounted in a fixed position thereon, to as the screw is rotated relative to the second bracket 48 as the screw is rotated. As the screw rotates in a first direction, the screw tends to move the first bracket 46 towards the second bracket 48 and lessens the distance of the space 34 between brackets. By manipulating the manually adjustable means F the spaces 34 may be so lengthened or shortened that the first and second arcuate sheet C-1 and C-2, together with the first, second, third and fourth pairs of bands 24, 26, 28 and 30 are forced into frictional contact with the cylindrical side wall 10 when the locking means E are in the first position shown in FIG. 5. By moving the locking means E to the second positions shown in FIG. 6, the handle assembly A is expanded and may be moved longitudinally off the bottle B or moved longitudinally thereon to the position shown in FIGS. 1 and 2.

The use and operation of the handle assembly has been explained previously in detail and need not be repeated.

I claim:

1. A handle assembly that is removably attachable to a carboy bottle of the type that has a straight cylindrical side wall to permit said bottle to be lifted and placed in an inverted position, which assembly includes:

a. first and second transversely arcuate rigid sheets that may be disposed on opposite sides of said carboy bottle and in abutting contact therewith, said first and second sheets each having upper and lower circumferential edges, said first sheet when said carboy bottle is in an upright position having vertical first and second edges that extend between said upper and lower circumferential edges thereof, and said second sheet having third and fourth vertical edges that extend between said upper and lower edges thereof;

b. first and second handles secured to said first and second sheets;

c. first, second, third and fourth pairs of pliable horizontal bands, said first and second pairs of bands connected to said first sheet and extending in opposite directions from said first and second edges thereof, said third and fourth pairs of bands connected to said second sheet and extending in opposite directions from said third and fourth edges thereof, said first and third pairs of bands having free ends that are separated by a first space, and said second and fourth bands having free ends that are separated by a second space;

d. a pair of first manually operable locking means connected to said free ends of said first and third pairs of bands and disposed in said first spaces, said first manually operable locking means capable of occupying first and second positions, said first manually operated locking means when in said first positions holding said free ends of said first and third pairs of bands a minimum distance from one another, and said first manually operable locking means when in a second position holding said free ends of said first and third pairs of bands in a maximum distance from one another; and e. a pair of manually adjustable means connected to said free ends of said second and fourth pairs of bands disposed in said second spaces for so adjusting the lengths of said second spaces that when said first manually operable locking means are moved from said second to said first position said first and second sheets and said first, second, third and fourth bands are forced into pressure frictional contact with said cylindrical side wall to the extent said carboy bottle may be lifted by said first and second handles and disposed in an inverted position, and said first manually operable locking means when in said second position increasing the length of said second spaces that said handle assembly may be moved longitudinally relative to said cylindrical side wall of said carboy bottle to be mounted on or removed from the latter.

2. A handle assembly as defined in claim 1 wherein each of said handles is of elongate U shape, projects outwardly from that one of said sheets on which it is mounted, and is angularly disposed on said sheet.

3. A handle assembly as defined in claim 1 wherein each of said first manually operable locking means includes:

f. first and second brackets secured to the free ends of one of the pairs of said first and third bands;

g. a pivot member secured to said second bracket;

h. a handle pivotally supported on said pivot member; and g. a link pivotally connected to said first bracket and to said handle, with said handle when pivoted from a second to a first position moving said link inwardly to engage said pivot member and minimize the length of said first space.

4. A handle assembly as defined in claim 1 wherein each of said pair of manually adjustable means includes:

f. first and second tabs that project outwardly from the free end of said second and fourth bands adjacent said second space; and g. a screw rotatably supported in a non-longitudinally movable position in said first tab that engages a tapped bore in said second tab.

* * * * *

UNITED STATES PATENT OFFICE

CERTIFICATE OF CORRECTION

Patent No. 3,964,126 Dated June 22, 1976

Inventor(s) FRED C. MADSEN

It is certified that error appears in the above-identified patent and that said Letters Patent are hereby corrected as shown below:
In the inventor's address delete "844 San Pablo St., Long Beach, Calif. 90813" and insert --- 13311 Sioux Road, Westminster, California 92683 ---.

Signed and Sealed this

Twenty-first Day of September 1976

[SEAL]

*Attest:*

RUTH C. MASON
*Attesting Officer*

C. MARSHALL DANN
*Commissioner of Patents and Trademarks*